US008490891B2

(12) United States Patent
Chen

(10) Patent No.: US 8,490,891 B2
(45) Date of Patent: Jul. 23, 2013

(54) WASHING FLUID SUPPLY STRUCTURE OF WATER OUTLET DEVICE AND SHOWER DEVICE

(75) Inventor: Tianyu Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 174 days.

(21) Appl. No.: 13/125,696

(22) PCT Filed: Oct. 29, 2009

(86) PCT No.: PCT/CN2009/074675

§ 371 (c)(1),
(2), (4) Date: Apr. 22, 2011

(87) PCT Pub. No.: WO2010/063204

PCT Pub. Date: Jun. 10, 2010

(65) Prior Publication Data

US 2011/0215174 A1 Sep. 8, 2011

(30) Foreign Application Priority Data

Dec. 1, 2008 (CN) ..... 2008 1 0072278

(51) Int. Cl.

| | |
|---|---|
| ***B05B 7/26*** | (2006.01) |
| ***B05B 1/18*** | (2006.01) |
| ***B05B 7/24*** | (2006.01) |
| ***B05B 9/047*** | (2006.01) |
| ***B05B 9/04*** | (2006.01) |

(52) U.S. Cl.
USPC ..... 239/312; 239/310; 239/320; 239/322; 239/447; 4/605; 4/903

(58) Field of Classification Search
USPC ..... 239/10, 302, 310, 312, 313, 315, 239/316, 318, 320–322, 398, 407, 409, 410, 239/436, 443, 447–449, 525, 548, 556; 4/605, 4/615, 903; 222/630, 636
See application file for complete search history.

(56) References Cited

U.S. PATENT DOCUMENTS

| | | | | |
|---|---|---|---|---|
| 3,713,585 | A * | 1/1973 | Conklin | 239/307 |
| 6,145,757 | A * | 11/2000 | Knapp | 239/443 |
| 6,647,566 | B1 | 11/2003 | Wang | |
| 6,926,212 | B1 | 8/2005 | Glass | |

FOREIGN PATENT DOCUMENTS

| | | | |
|---|---|---|---|
| CN | 2178491 | Y | 10/1994 |
| CN | 1174273 | A | 2/1998 |
| CN | 2317793 | Y | 5/1999 |
| CN | 2476241 | Y | 2/2002 |
| CN | 1380036 | A | 11/2002 |
| CN | 101143078 | A | 3/2008 |
| CN | 101462096 | A | 6/2009 |
| CN | 201333430 | Y | 10/2009 |

* cited by examiner

*Primary Examiner* — Darren W Gorman
(74) *Attorney, Agent, or Firm* — Rabin & Berdo, P.C.

(57) ABSTRACT

A washing fluid supply structure of a water outlet device and a shower device, is arranged in the water supply pipeline of the water outlet device. It has a container for washing liquid, and a fluid supply device disposed in a main body which is a water flow pipeline. The upper end of the water flow pipeline is connected with a water supply pipeline, and the lower end of the water flow pipeline is connected with the water outlet device. A connecting pipe connects the container to the fluid supply device. The washing liquid flows into the fluid supply device through a pathway of one-way valves. The fluid supply device is connected to the water outlet device through a washing fluid delivery pipe. The washing liquid in the fluid supply device flows into the water outlet device through the pathway.

14 Claims, 6 Drawing Sheets

WASHING FLUID SUPPLY STRUCTURE OF WATER OUTLET DEVICE AND SHOWER DEVICE

FIELD OF THE INVENTION

The present invention relates to an accessory of water outlet device and a shower device applied in washroom or kitchen, especially relates to a washing fluid supply structure of water outlet device and a shower device.

BACKGROUND OF THE INVENTION

In the conventional technique, the fluid supply device and the water outlet device are separated in washroom or kitchen. Generally, when the user takes a bath, firstly he needs to get soaked with water outlet device, then takes some washing liquid from the fluid supply device to his body and finally rinse off the washing liquid with water outlet device for thoroughly cleaning. However, there is some inconvenience: if the user needs to bathe quickly, or the user is a athlete who needs to bathe several times a day, or the user is a movement disorder, or the user needs to bathe his pet, the operation in the conventional technique may be complex and inconvenient. Therefore it needs to simplify the bath process and solve the above problems, so that the user can directly use bubble water fluid from the shower for cleaning.

SUMMARY OF THE INVENTION

The first objective of the present invention is to provide a water fluid supply structure of water outlet device, which not only supply water from the water outlet device, but also supply washing liquid when the water sprayed from the water outlet device, so as to achieve the convenient, fast and clean washing effects.

The second objective of the present invention is to provide a shower device applied above water fluid structure.

The present invention applies the following solution to achieve the above purpose: a washing fluid supply structure of water outlet device, which is arranged in the water supply pipeline of the water outlet device, wherein it comprises a container for containing washing liquid, a main body and a fluid supply device, said fluid supply device is arranged in the main body which is a water flow pipeline; the upper end of the water flow pipeline is connected with a water supply pipeline, and the lower end of the water flow pipeline is connected with the water outlet device; the fluid supply device is communicated with the container through a connecting pipe, and one-way valves through which the washing liquid in the container flows into the fluid supply device are arranged in the pathway; further said fluid supply device is communicated with said water outlet device through a washing fluid delivery pipe, said pathway further has one-way valves through which the washing liquid in the fluid supply device flows into the water outlet device; said fluid supply device supplies the washing liquid for said water outlet device under hydraulic pressure.

Said fluid supply device comprises a piston chamber, a piston rod and a reset spring, an end of said reset spring is fixed on said piston chamber, another end of said reset spring resists against said piston rod, said reset spring will switch from releasing to compressing when said piston rod moves in the piston chamber up and down.

Said piston chamber is integrated into the inner wall of the main body or fixed in the main body, a fluid inlet and a fluid outlet are arranged on the lower end of the piston chamber, there are one-way valves respectively disposed in said fluid inlet and said fluid outlet.

Said container is connected with said main body and respectively forms independent spaces.

Said main body is disposed approaching the middle of the container, an upper cover is arranged on the water inlet of the upper portion of the main body, said upper cover has a dummy club with a through hole, further a lower cover is arranged on the water outlet of the lower portion of the main body, said lower cover has a dummy club with a through hole; said container is a casing, which sleeves outside of the main body, a guard board is connected with the outer wall of the main body and disposed approaching the middle portion of the inner wall, a space for containing the washing liquid is formed between the main body and the upper surface of the guard board, the upper end of said container has a container cover with a through hole for the upper cover of said main body passing through, the lower end of said container has a fixing cover with a through hoe for the lower cover of said main body passing through, an opening of said connecting pipe is disposed on said guard board and communicated with said space for containing washing liquid, another opening of said connecting pipe is communicated with said fluid supply device.

Shower device, comprising a washing fluid supply structure, a shower head, said washing fluid supply structure is arranged in the water supply pipeline for the shower head;

Said shower head comprises a main body, a water division member, a water outlet device and a diverter; said water division member has two water division holes, said diverter selectively controls the fluid spray hole or the shower head hole to be opened, and controls the washing fluid delivery pipe to be open or closed.

Said diverter comprises a shower head button, a washing liquid button, two pressing rods and a seesaw, the middle of said seesaw is arranged on said water division member and between the two water division holes, while the two ends of said seesaw rightly seals and buckles said two water division holes; and one ends of the two pressing rods respectively resists against the two ends of the seesaw, the opposite ends of the two pressing rods respectively connected with the shower head button and the washing liquid button, said shower head button and the washing liquid button are movably disposed on the rear portion of the shower head main body.

Said shower head is hermetically connected with the outlet of the shower head main body through a flexible pipe, the washing fluid delivery pipe is adapted to the length of the flexible pipe and disposed inside the flexible pipe, an end of said washing fluid delivery pipe is hermetically communicated with the outlet of said piston chamber, while another end of said washing fluid delivery pipe extends inside the fluid outlet of the shower head main body, further a one-way valve is disposed on said fluid outlet of the main body of the shower head and controlled by said diverter so as to switch from opening to closing, and further to determine whether the washing liquid can be flowed out of the shower head or not by said diverter An air intake device is disposed on the fluid spray hole.

Said water outlet device is a shower head or a spray gun.

After applying the above solution, since the fluid supply device of the present invention is disposed in the main body which is a water flow pipeline, and the fluid supply device, and the water outlet device is unidirectionally cooperated with the fluid supply device and the container, so when the user operates the water outlet device, the fluid supply device will extrude the washing liquid into the water outlet device due to the water pressure, that is the user can directly get the washing liquid by starting the control device of the water outlet device, the washing fluid sprayed from the water outlet device can generate rich foams, so as to achieve the convenient, fast and clean washing effects.

DETAILED DESCRIPTION OF THE EMBODIMENTS

Figure 1:
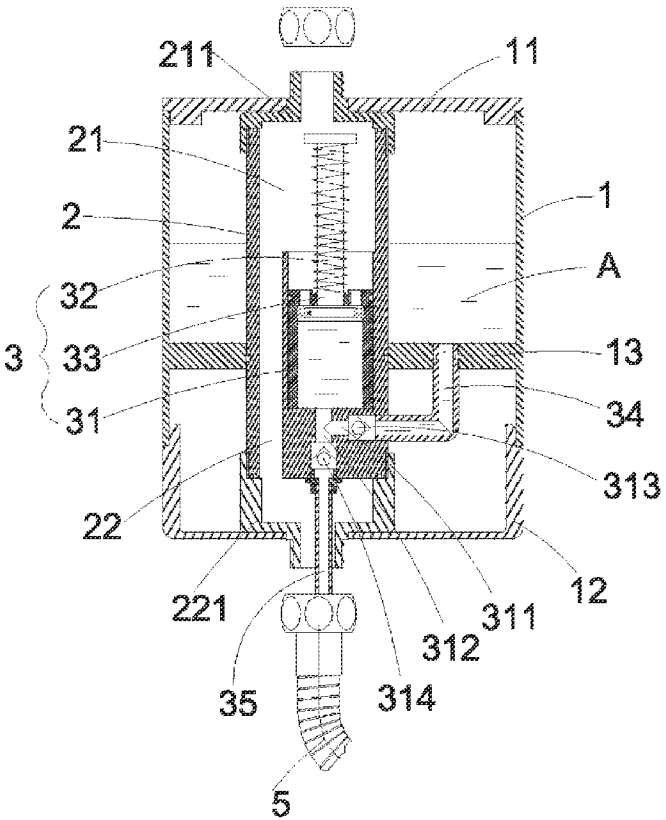
FIG. 1 is the sectional view of the first embodiment of the present invention.

Embodiment 1, please refer to FIG. 1, the washing fluid supply structure of the water outlet device of the present invention comprises a container 1, a main body 2 and a fluid supply device 3.

The container 1 is used for containing the washing liquid, which has an openable cover for the washing liquid A to be filled in.

The main body 2 is a chamber which is arranged in the water supply pipeline, the upper end of which is a water inlet 21 connected with the water supply pipeline, the lower end of which is a water outlet 22 connected with the water outlet device such as shower head or spray gun.

The fluid supply device 3 is disposed in the main body 2, which comprises a piston chamber 31, a piston rod 32 and a reset spring 33. An end of said reset spring 33 is fixed on the piston chamber 31 while its opposite end resists against the piston rod 32. The reset spring 33 will switch from releasing to compressing when said piston rod 32 moves in the piston chamber 31 up and down.

Said piston chamber 31 is integrated into the inner wall of the main body 2 or fixed in the main body 2, a fluid inlet 311 and a fluid outlet 312 are arranged on the lower end of the piston chamber 31, the one-way valves 313, 314 are respectively disposed in said fluid inlet 311 and said fluid outlet 312; the fluid inlet 311 is communicated with the container 1 through the connecting pipe 34, the washing liquid A in the container 1 can flow into the piston chamber 31 unidirectionally under the control of the one-way valve 313, that is the fluid in the piston chamber 31 can not flow into the container 1; the fluid outlet 312 is communicated with the water outlet device such as shower head and so on through the washing fluid delivery pipe 35, the fluid in the piston chamber 31 can flow into the shower head unidirectionally under the control of the one-way valve 314, that is the fluid in the shower head can not flow backwards into the piston chamber 31.

The container 1 is connected with the main body 2, they respectively forms independent spaces; alternatively, the main body 2 can be arranged by one side of the container 1 or arranged in the container 1, as showed in the accompanying drawings of the present embodiment, said main body 2 is disposed approaching the middle of the container 1, the water inlet 21 on the upper portion of the main body 1 has an upper cover 211, said upper cover 211 has a dummy club with a through hole, further a lower cover 221 is arranged on the water outlet 22 of the lower portion of the main body, said lower cover 221 has a dummy club with a through hole; the container 1 is a casing, which sleeves outside the main body 2, the middle portion of its inner wall has a guard board 13 connected with the outer wall of the main body 2, so that a room for containing the washing liquid A is formed between the main body 2 and the upper surface of the guard board 13, a container cover 11 is disposed on the upper end of said container 1, a though hole is set on said container cover 11 for the upper cover of the main body 2 passing through, a fixing cover 12 is disposed on the lower end of said container 1, another through hole is set on said fixing cover 12 for the lower cover of the main body passing through, an opening of said connecting pipe 34 is set on the guard board 13 and communicated with the fluid containing room, while anther opening is communicated with the fluid inlet 311 of the piston chamber 31 by passing through the side wall of the main body 2.

Figure 2:
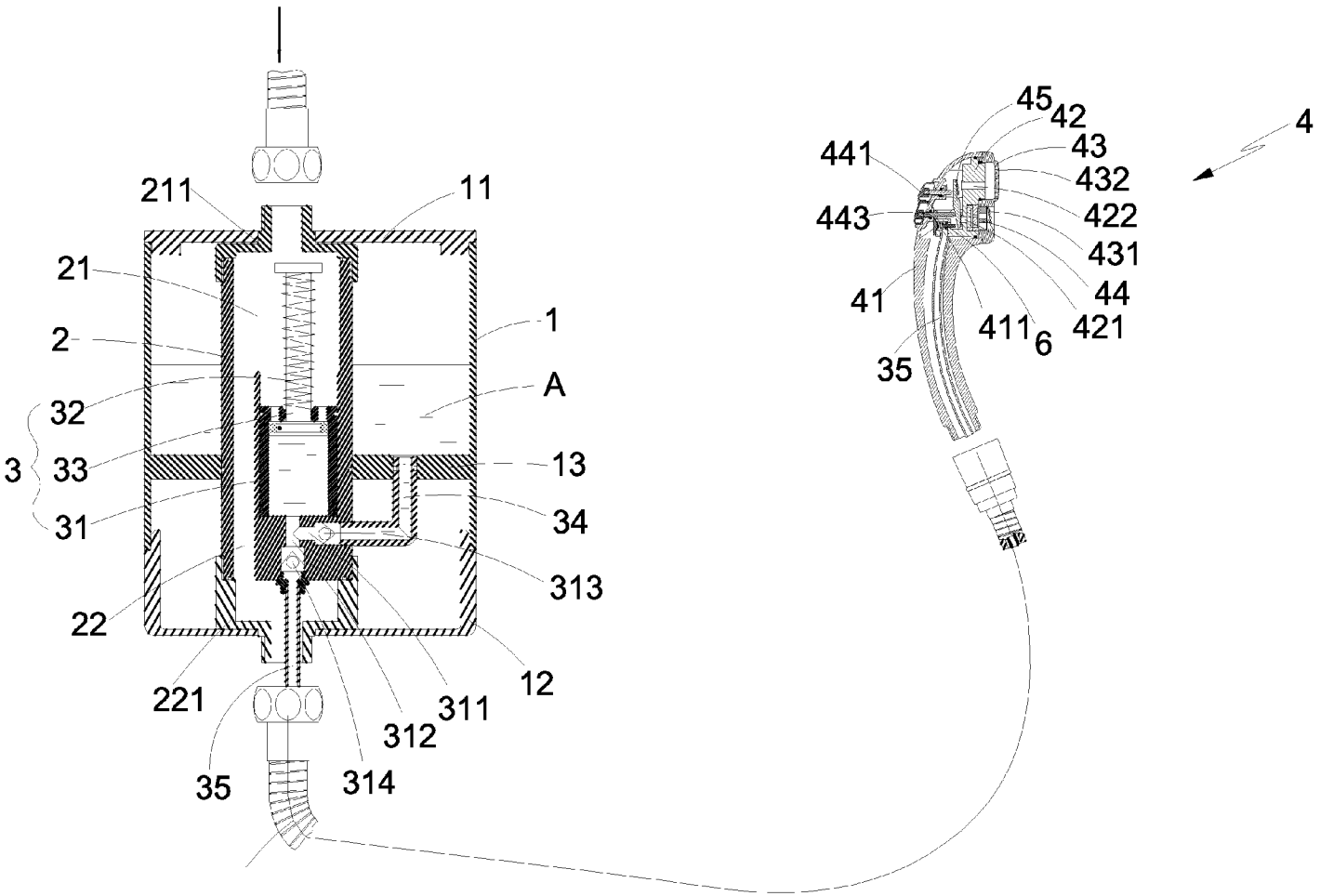
FIG. 2 is the first sectional view of the second embodiment of the present invention.
Figure 3:
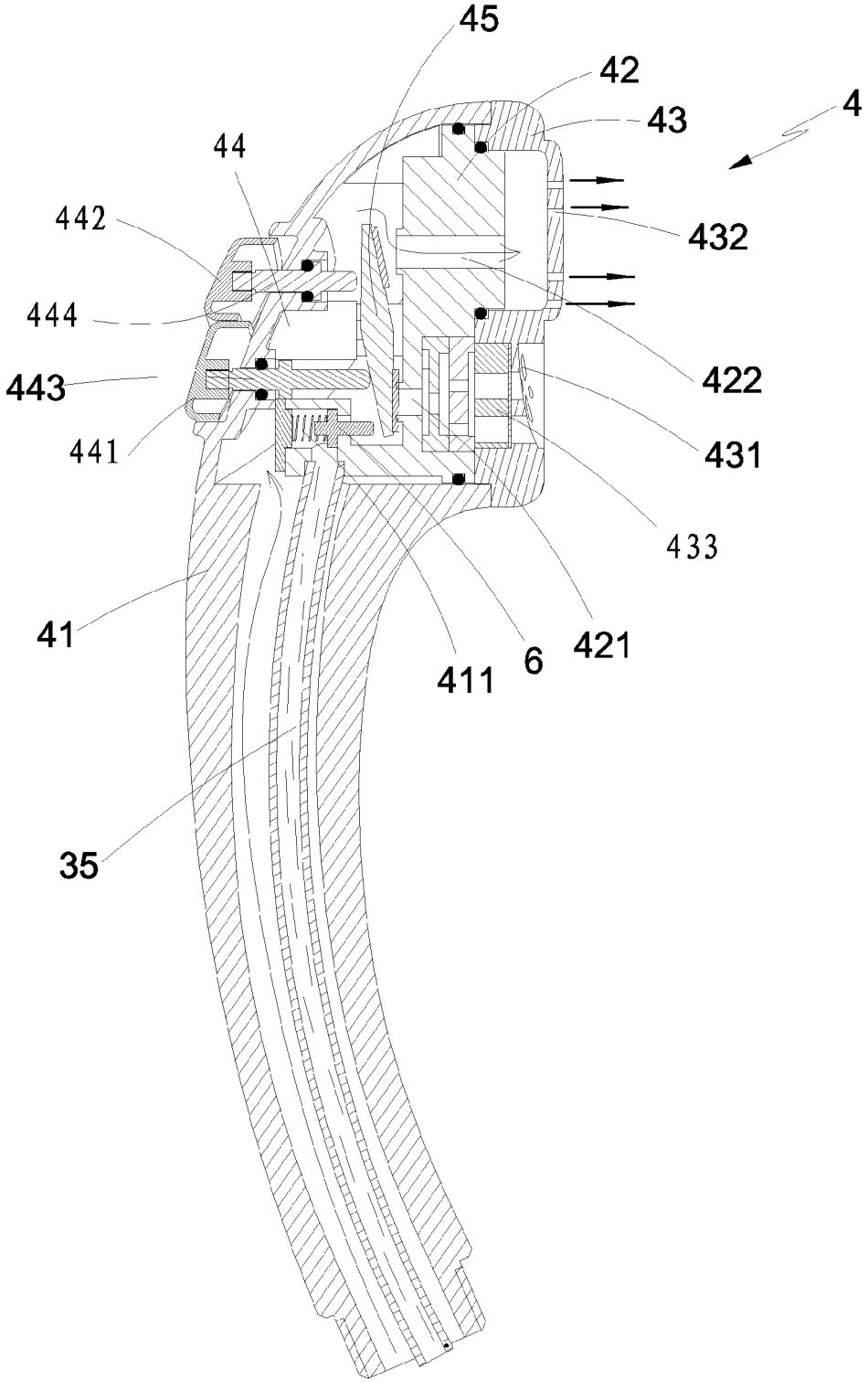
FIG. 3 is the first sectional view of the shower head of the second embodiment of the present invention.
Figure 4:
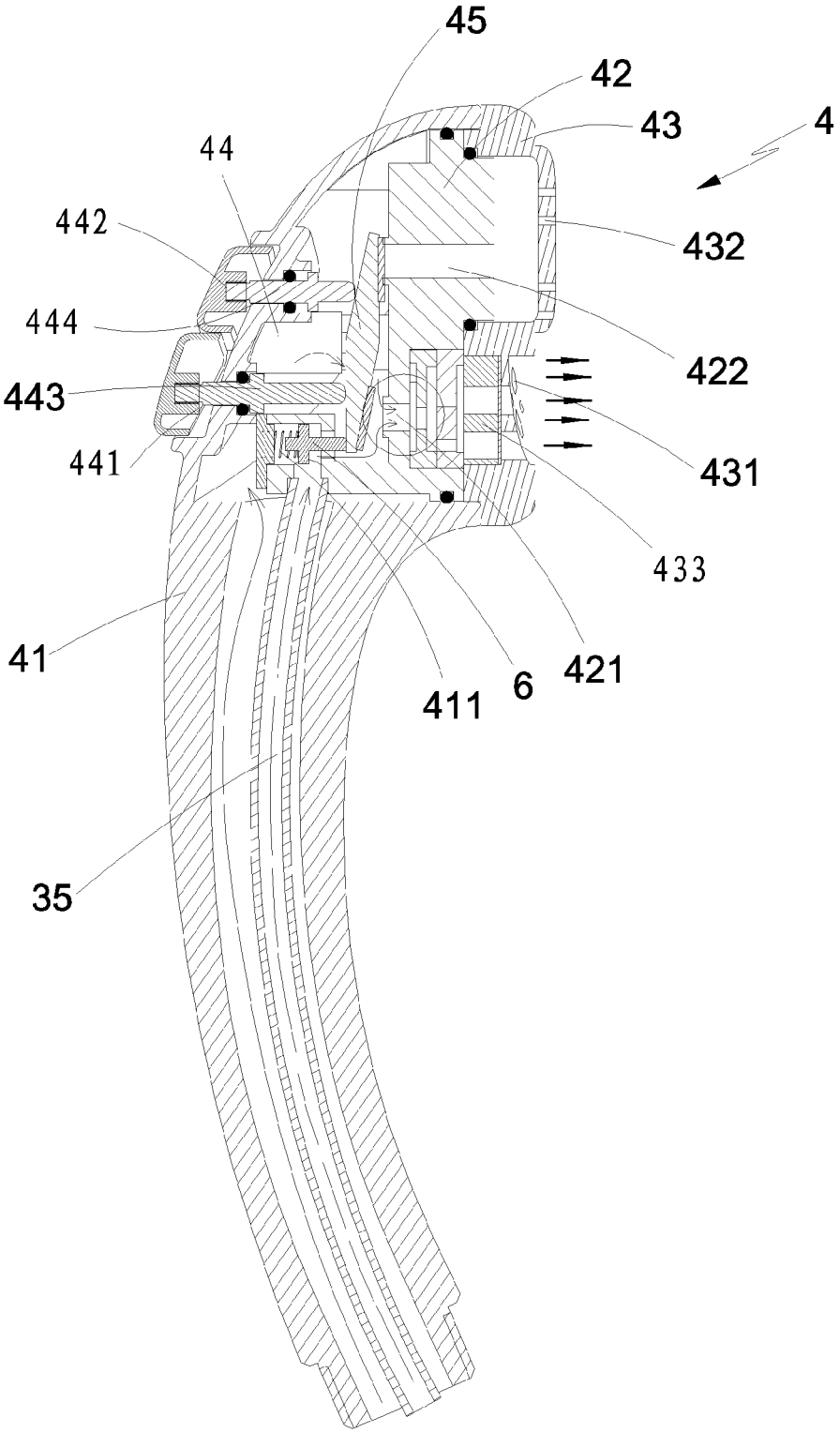
FIG. 4 is the second sectional view of the shower head of the second embodiment of the present invention.

Embodiment 2, a shower device comprises the washing fluid supply structure of embodiment 1 and a shower head 4, said washing fluid supply structure is arranged in the water supply pipeline for the shower head 4;

As showed in FIG. 2 and FIG. 3, the shower head 4 comprises a main body 41, a water division member 42, a water outlet device 43 and a diverter 44.

Said shower head 4 is hermetically connected with the lower cover 221 of the outlet 22 of the main body 2 through a flexible pipe 5, the washing fluid delivery pipe 35 is adapted to the length of the flexible pipe 5 and disposed inside the flexible pipe 5, an end of said washing fluid delivery pipe 35 is hermetically communicated with the fluid outlet 312 of said piston chamber 31, while another end of said washing fluid delivery pipe 35 extends inside the fluid outlet chamber 411 of the shower head main body 41, further a one-way valve 6 is disposed on said fluid outlet chamber 411 and controlled by said diverter 44 so as to switch from open to closed, said diverter further determine whether the washing liquid can be flowed out of the shower head 4 or not.

Said water division member 42 has two water division holes 421, 422 for respectively communicated with the fluid spray hole 431 and the shower head spray hole 432; an air intake device 433 is disposed on the fluid spray hole 431.

Said diverter 44 comprises a shower head button 441, a washing liquid button 442, two pressing rods 443,444 and a seesaw 45. The middle of said seesaw 45 is arranged on said water division member 42 and between the two water division holes 421 and 422, while the two ends of said seesaw 42 rightly seals and buckles said two water division holes 421 and 422. First ends of the two pressing rods 443,444 respectively resist against two ends of the seesaw 45. Opposite ends of the two pressing rods 443,444 are respectively connected with the shower head button 441 and the washing liquid button 442. Said shower head button 441 and the washing liquid button 442 are movably disposed on the rear portion of the main body 41.

The container 1 is filled with washing liquid A, so that the piston rod 32 of the fluid supply device 3 will move upward under the action of the reset spring 33, and the washing liquid A in the container 1 will be drawn into the piston chamber 31 and filled in the whole piston chamber 31.

Figure 5:
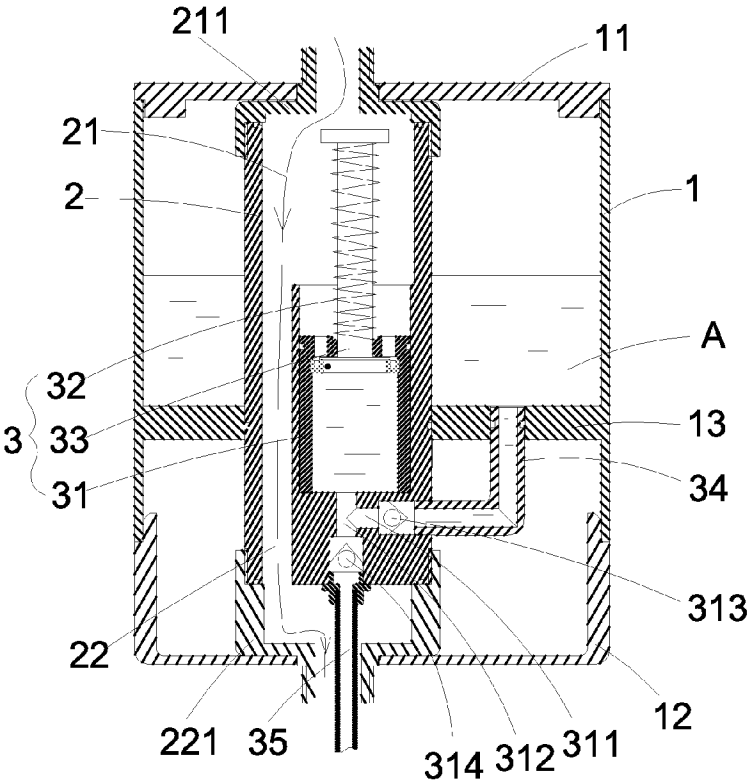
FIG. 5 is the first operation status of the washing fluid supply structure of the second embodiment of the present invention.

Please refer to FIG. 3 and FIG. 5, after the water supply one-way valve is being opened, if the user needs to bathe with only water, firstly he presses the shower head button 441, so the pressing rod 443 will push against the left end of the seesaw 45 to move downward, so the water division hole 421 will be sealed, after that the right end of the seesaw 45 will move upward to open the water division hole 422, the shower head 4 will spray water, since the one-way valve 6 of the shower head 4 is closed, so the washing fluid delivery pipe 35 is closed, so that the upper and lower end of the piston rod 32 will keep balance, meanwhile the fluid supply device does not supply washing liquid A.

Figure 6:
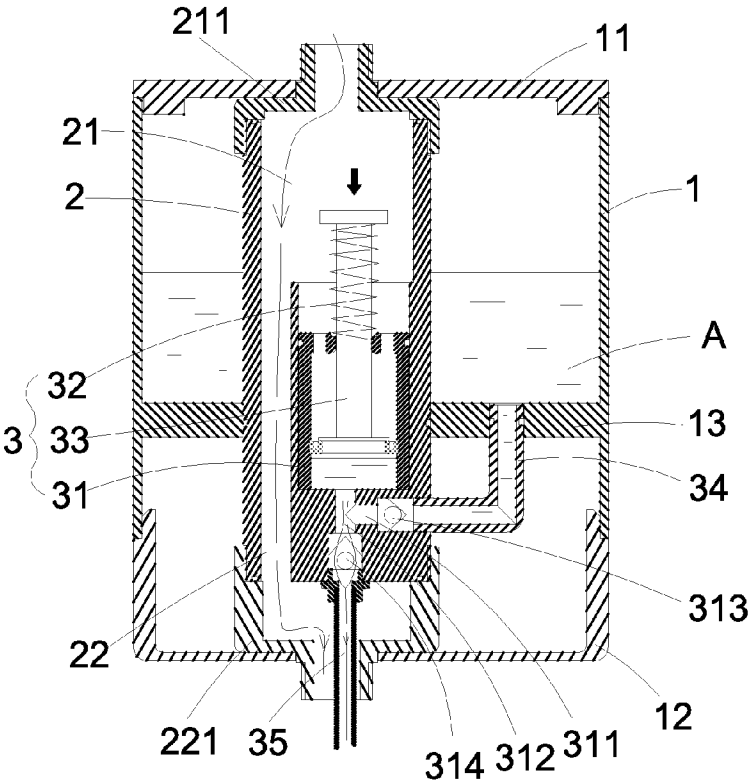
FIG. 6 is the second operation status of the washing fluid supply structure of the second embodiment of the present invention.
Figure 8:
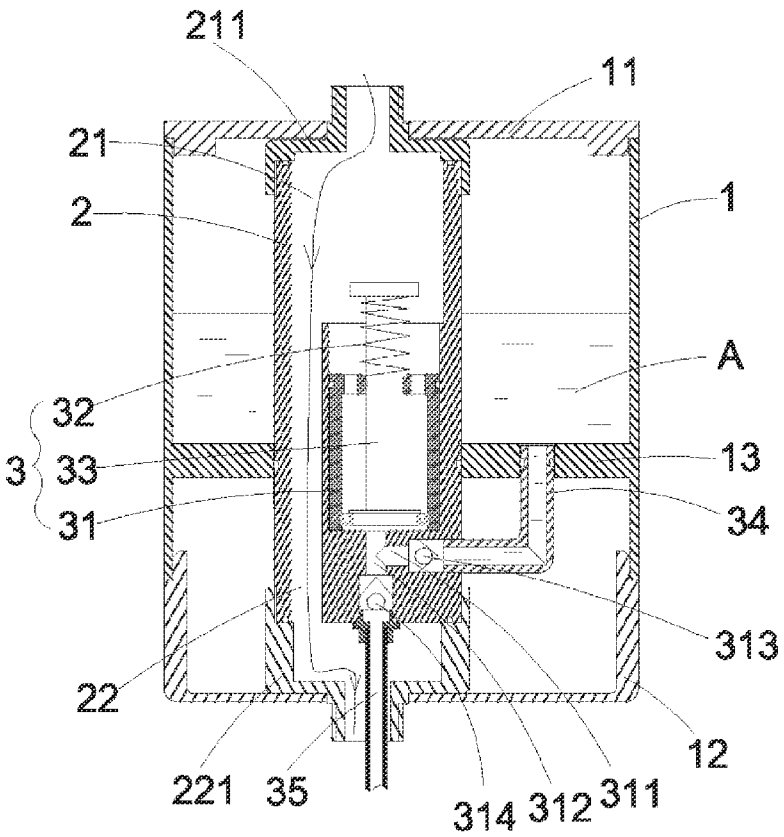
FIG. 8 is the third operation status of the washing fluid supply structure of the second embodiment of the present invention.

Please refer to FIG. 3, FIG. 6 and FIG. 8. If the user presses the washing liquid button 442, the pressing rod 444 will be driven to push against the right end of the seesaw 45 to move downward, so the water division hole 422 of the water division member 42 will be sealed. After that the left end of the seesaw will move upward to open the water division hole 421. Meanwhile the one-way valve 6 is opened, so the washing fluid delivery pipe 35 will be communicated with the shower head spray hole 431. At this time the water pressure exerted on the upper end of the piston rod 32 of the fluid supply device 3 of the main body 2 will gradually increase until it is greater than the resistance exerted on the lower end of the piston rod 32, so the piston rod 32 will move downward, and the reset spring 33 is compressed for storing energy. The washing liquid A in the piston chamber 31 will be extruded to the fluid spray hole 431 through the washing fluid delivery pipe 35, then passes through the air intake device 433 after mixing with the water. Finally the washing fluid with foam will be sprayed out of the shower head 4. At this time, the one-way valve 314 is in opening status, while the one-way valve 313 is in closing status, such that it will effectively prevent the washing liquid A from flowing backward into the container 1.

After the piston rod moves to the bottom of the piston chamber 31, the washing liquid A in the piston chamber 31 will be wholly transmitted, so that there will be only water sprayed out of the shower head, alternatively, the fluid supply device 3 is designed to supply a predetermined amount of washing liquid, so that the washing liquid will be saved since it isn't being supplied continuously.

Figure 7:
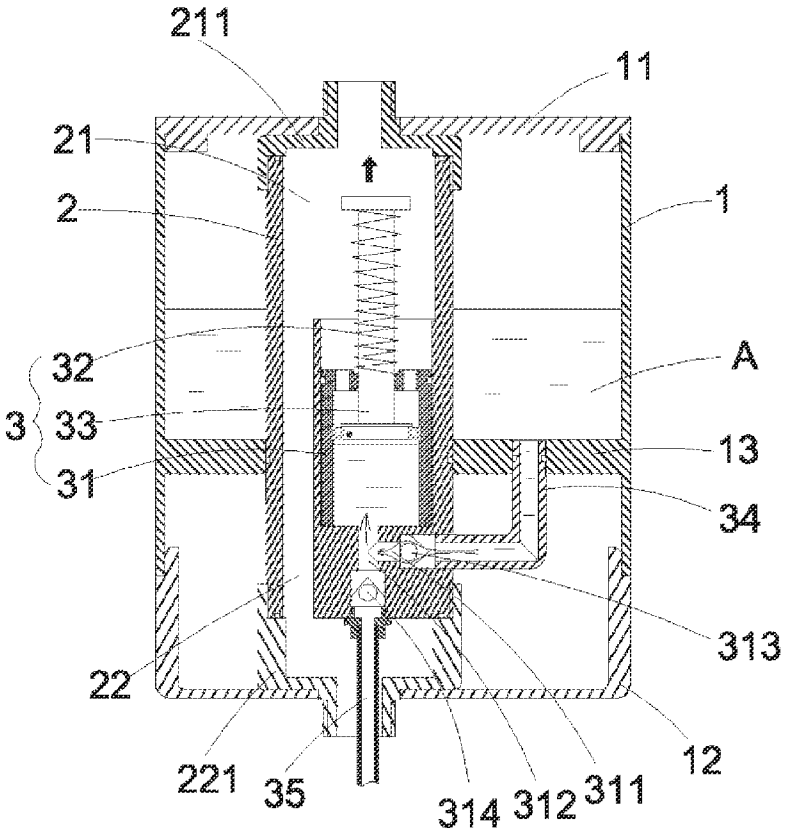
FIG. 7 is the fourth operation status of the washing fluid supply structure of the second embodiment of the present invention.

Please refer to FIG. 7, after the water supply valve is closed, the water pressure will decrease, so the piston rod 32 will move upward relative to the piston chamber 31 under the reset force of the reset spring 33. At this time, the one-way valve 313 is open while the one-way valve 314 is closed automatically, and the washing liquid A will be drawn in the piston chamber 31 from the container 1, so that the washing liquid A can be automatically added for the next operation.

Referred from the above description, the washing liquid supply structure of the present invention, since its fluid supply device 3 is arranged in the main body 2 which is a water flow pipeline, and the water outlet device is unidirectionally cooperated with the fluid supply device 3 and container 1, so when the water outlet device is operated, said fluid supply device will extrude the washing liquid A into the water outlet device due to the water pressure, so the user can directly use the washing liquid A by starting the control device of the water outlet device, and the washing fluid sprayed out of the water outlet device will generate rich foams, the effects of clean washing is achieved. It will not only satisfy the requirement for fast washing, but also convenient for the movement disorders to take a bath and convenient for cleaning the pets.

Furthermore, said fluid supply device also has the function of supplying a predetermined washing liquid, thus the washing liquid will not be wasted.

INDUSTRIAL APPLICABILITY

The washing fluid supply structure of water outlet device and a shower device of the present invention, wherein its washing fluid supply structure is arranged in the water supply pipeline of the water outlet device, said fluid supply device can extrude the washing liquid into the water outlet device during the operation, so that the user can directly use washing liquid in the operation, and the washing fluid sprayed from the water outlet device will generate rich foams, so as to achieve the convenient, fast and clean washing effects.

What is claimed is:

1. A washing fluid supply structure for a water outlet device, which is arranged in a water supply pipeline of the water outlet device, the washing fluid supply structure comprising:

a container for containing washing liquid, the container including a guard board, an upper end that has a container cover with a through hole, and a lower end having a fixing cover with a through hole;

a main body that is a water flow pipeline, an upper end of the main body being connected with the water supply pipeline, and a lower end of the main body being connected with the water outlet device, said main body being disposed so as to approach a middle of the container, the main body including a water inlet at an upper portion of the main body, a water outlet at a lower portion of the main body, an upper cover arranged on the water inlet of the upper portion of the main body, said upper cover having a dummy club with a through hole, the upper cover of said main body passing through the through hole of the upper end of the container, and a lower cover arranged on the water outlet of the lower portion of the main body, said lower cover having a dummy club with a through hole, the lower cover of said main body passing through the through hole of the lower end of the container;

a connecting pipe;

a fluid supply device for receiving the washing liquid from the container, said fluid supply device being arranged in the main body, the fluid supply device being communicated with the container through the connecting pipe, the fluid supply device supplying the washing liquid for said water outlet device under hydraulic pressure;

a first one-way valve through which the washing liquid in the container flows into the fluid supply device being arranged in a pathway;

a washing fluid delivery pipe, said fluid supply device being communicated with said water outlet device through the washing fluid delivery pipe; and a second one-way valve disposed in another pathway, the washing liquid in the fluid supply device flowing through the second one-way valve into the water outlet device, wherein said container is a casing which sleeves an outside of the main body, further wherein the guard board of the container is connected with an outer wall of the main body and disposed so as to approach a middle portion of an inner wall of the container, further wherein a space for containing the washing liquid is formed between the main body and an upper surface of the guard board, and further wherein an opening of said connecting pipe is disposed on said guard board and communicated with said space for containing the washing liquid, another opening of said connecting pipe is communicated with said fluid supply device.

2. The washing liquid supply structure for a water outlet device according to claim 1, wherein said fluid supply device comprises:

a piston chamber;

a piston rod; and a reset spring, an end of said reset spring being fixed on said piston chamber, another end of said reset spring resisting against said piston rod, said reset spring switching from releasing to compressing when said piston rod moves upward and downward in the piston chamber.

3. The washing fluid supply structure for a water outlet device according to claim 1, wherein said fluid supply device comprises a piston chamber, wherein said piston chamber is integrated into an inner wall of the main body or fixed in the main body, further wherein a fluid inlet and a fluid outlet are arranged on a lower end of the piston chamber, further wherein the first and second one-way valves are respectively disposed in said fluid inlet and said fluid outlet.

4. The washing fluid supply structure for a water outlet device according to claim 1, wherein said container is connected with said main body and respectively forms independent spaces.

5. A shower device, comprising:

a shower head including a shower head main body, a water division member having two water division holes, and a diverter selectively controlling whether a fluid spray hole or a shower head hole is to be opened;

a water supply pipeline for the shower head; and a washing fluid supply structure being arranged in the water supply pipeline, said washing fluid supply structure including a container for containing washing liquid, a main body being a water flow pipeline, an upper end of the main body of the washing fluid supply structure being connected with the water supply pipeline, and a lower end of the main body of the washing fluid supply structure being connected with the shower head, a connecting pipe, a fluid supply device for receiving the washing liquid from the container and being, arranged in the main body, the fluid supply device being communicated with the container through the connecting pipe, said fluid supply device supplying the washing liquid for said shower head under an action of water pressure, a first one-way valve through which the washing liquid in the container flows into the fluid supply device and being arranged in a pathway, a washing fluid delivery pipeline, said fluid supply device being communicated with said shower head through the washing fluid delivery pipeline, and a second one-way valve disposed in another pathway and through which the washing liquid in the fluid supply device flows into the shower head, wherein said diverter selectively controls the washing fluid delivery pipeline to be opened or closed.

6. The shower device according to claim 5, wherein said diverter comprises:

a shower head button movably disposed on a rear portion of the shower head main body;

a washing liquid button movably disposed on a rear portion of the shower head main body;

two pressing rods; and a seesaw, a middle of said seesaw being arranged on said water division member and between the two water division holes, while two ends of said seesaw seal and open said two water division holes, and wherein first ends of the two pressing rods are respectively resisting against the two ends of the seesaw, while opposite ends of the two pressing rods are respectively connected with the shower head button and the washing liquid button.

7. The shower device according to claim 5, further comprising a flexible pipe, said shower head being hermetically connected with an outlet of the main body of the washing fluid supply structure through the flexible pipe, wherein said fluid supply device includes a piston chamber having a fluid outlet, wherein the washing fluid delivery pipeline is adapted to the length of the flexible pipe and disposed inside the flexible pipe, wherein an end of said washing fluid delivery pipeline is hermetically communicated with the fluid outlet of said piston chamber, while another end of said washing fluid delivery pipeline extends inside a fluid outlet of the shower head main body, further wherein the shower head comprises a one-way valve disposed on said fluid outlet of the shower head main body and controlled by said diverter so as to switch from opening to closing, and wherein said diverter further determines whether the washing liquid flows out of the shower head.

8. The shower device according to claim 5, wherein the shower head includes an air intake device disposed on the fluid spray hole.

9. The shower device according to claim 5, wherein said fluid supply device comprises:

a piston chamber;

a piston rod; and a reset spring, an end of said reset spring being fixed on said piston chamber, another end of said reset spring resisting against said piston rod, said reset spring switching from releasing to compressing when said piston rod moves upward and downward in the piston chamber.

10. The shower device according to claim 9, wherein said piston chamber is integrated into an inner wall of the main body of the washing fluid supply structure or fixed in the main body of the washing fluid supply structure, wherein a fluid inlet and a fluid outlet are arranged on a lower end of the piston chamber, further wherein the first and second one-way valves are respectively disposed in said fluid inlet and said fluid outlet.

11. The shower device according to claim 5, wherein said container is connected with said main body of the washing fluid supply structure and respectively forms independent spaces.

12. The shower device according to claim 5, wherein said main body of the washing fluid supply structure is disposed approaching a middle of the container, the main body of the washing fluid supply structure including a water inlet at an upper portion of the main body of the washing fluid supply structure, a water outlet at a lower portion of the main body of the washing fluid supply structure, an upper cover arranged on the water inlet of the upper portion, said upper cover having a dummy club with a through hole, a lower cover arranged on the water outlet of the lower portion, said lower cover having a dummy club with a through hole, wherein said container is a casing, which sleeves an outside of the main body of the washing fluid supply structure, wherein the container includes a guard board connected with an outer wall of the main body of the washing fluid supply structure and disposed so as to approach a middle portion of an inner wall of the container, a container cover on an upper end of said container, the container cover having a through hole for the upper cover to pass therethrough, a fixing cover on a lower end of the container, the fixing cover having a through hole for the lower cover to pass therethrough, further wherein a space for containing the washing liquid is formed between the main body and an upper surface of the guard board, further wherein an opening of said connecting pipe is disposed on said guard board and communicated with said space for containing the washing liquid, and another opening of said connecting pipe is communicated with said fluid supply device.

13. The washing fluid supply structure for a water outlet device according to claim 2, wherein said piston chamber is integrated into an inner wall of the main body or fixed in the main body, further wherein a fluid inlet and a fluid outlet are arranged on a lower end of the piston chamber, further wherein the first and second one-way valves are respectively disposed in said fluid inlet and said fluid outlet.

14. The shower device according to claim 6, further comprising a flexible pipe, said shower head being hermetically connected with an outlet of the main body of the washing fluid supply structure through the flexible pipe, wherein said fluid supply device includes a piston chamber having a fluid outlet, wherein the washing fluid delivery pipeline is adapted to a length of the flexible pipe and disposed inside the flexible pipe, wherein an end of said washing fluid delivery pipeline is hermetically communicated with the fluid outlet of said piston chamber, while another end of said washing fluid delivery pipeline extends inside a fluid outlet of the shower head main body, further wherein the shower head comprises a one-way valve disposed on said fluid outlet of the shower head main body and controlled by said diverter so as to switch from opening to closing, and said diverter further determines whether the washing liquid flows out of the shower head.

* * * * *